United States Patent [19]

Schlaifer

[11] Patent Number: 4,838,827

[45] Date of Patent: Jun. 13, 1989

[54] WADDLING TOY FIGURE AND METHOD OF USING SAME

[75] Inventor: Roger L. Schlaifer, Atlanta, Ga.

[73] Assignee: Schlaifer Nance & Co., Inc., Atlanta, Ga.

[21] Appl. No.: 51,407

[22] Filed: May 19, 1987

[51] Int. Cl.[4] ..... A63H 3/14; A63H 3/02

[52] U.S. Cl. ..... 446/327; 446/369

[58] Field of Search ..... 446/327, 328, 369, 370, 446/371, 372

[56] References Cited

U.S. PATENT DOCUMENTS

| | | | |
|---|---|---|---|
| 2,655,762 | 10/1953 | Burke | 446/327 |
| 3,314,188 | 4/1967 | Peterson | 446/327 X |
| 3,611,628 | 10/1971 | Nobel et al. | 46/154 |
| 3,613,301 | 10/1971 | Nobel et al. | 46/154 |
| 3,942,283 | 3/1976 | Rushton | 446/327 |
| 4,202,135 | 5/1980 | Siler | 46/154 |
| 4,300,307 | 11/1981 | Biasuzzi et al. | 446/328 |
| 4,304,065 | 12/1981 | Baiera | 446/327 |

FOREIGN PATENT DOCUMENTS

| | | | |
|---|---|---|---|
| 2171324 | 8/1986 | United Kingdom | 446/327 |

*Primary Examiner*—Mickey Yu
*Assistant Examiner*—D. Neal Muir
*Attorney, Agent, or Firm*—Foley & Lardner, Schwartz, Jeffery, Schwaab, Mack, Blumenthal & Evans

[57] ABSTRACT

A toy figure is disclosed having a body and feet extending from the body. Pockets in the feet receive parts of the user's hands. The pockets and feet extend perpendicularly with respect to the upright axis of the body and parallel to the surface on which the toy figure will be used. When the user's fingers are moved through vertical arcs, the toy figure will move in an action resembling waddling.

3 Claims, 3 Drawing Sheets

WADDLING TOY FIGURE AND METHOD OF USING SAME

FIELD OF THE INVENTION

The present invention relates to toy figures, and, in particular, to toy figures which, with the use of human hands, are movable in a manner resembling waddling.

BACKGROUND OF THE INVENTION

It is known to provide toy figures, including toy figures in the form of stuffed animals, in which the user's fingers are inserted into the figure generally along the length of, and coextensive with, the figure's legs. The fingers of the user may then perform a walking action, so that movement of the fingers through sequential strides or steps causes the figure to appear to be walking. Figures of this type are disclosed in U.S. Pat. Nos. 3,611,628; 3,613,301; and 4,202,135.

The present invention is directed to a toy figure which provides a more distinctive, unexpected and entertaining motion than that of the known toy figures designed for a walking action. According to the present invention, the hands or fingers of the user are inserted into envelopes or pockets in the feet, rather than the legs, and extend generally parallel to the surface on which the toy figure is disposed. An arcuate, upward and downward alternating movement of the hands or fingers produces a unique and entertaining waddling motion of the figure as a whole, to thus provide the user with enhanced play and entertainment value.

These advantages are achieved by a toy figure which includes a body having an axis which extends generally vertically when the toy figure is in an upright condition. The toy figure also includes a pair of feet, each foot of the pair of feet having a lengthwise axis. Each foot has a front, which front is spaced from the body, and the axis of each foot extends generally perpendicularly to the axis of the body. Each foot has a pocket therein for receiving at least part of a human hand. The pocket of each foot extends toward the front of each foot in the direction of the axis of the foot. In this way, the part of the human hand, when inserted in the pocket, will extend along the axis of the foot in a direction toward the front of the foot.

In one embodiment of the invention, in which a relatively large figure is provided, each pocket is of such size and configuration as to snugly accommodate at least the majority of the fingers of one human hand. In this embodiment, one human hand is inserted into the pocket of one foot, the other human hand is inserted into the pocket of the other foot, and the hands are moved such that the finger tips describe an arc to thus produce the waddling action.

According to another embodiment, i.e., a smaller embodiment, each pocket is of such size and configuration as to snugly accommodate one finger of a human hand. In this embodiment, one finger is inserted into the pocket of one foot and another finger inserted into the pocket of the other foot so that a pair of human fingers may be used to produce the waddling action.

In both embodiments, the body of the figure is constructed of a flexible fabric enclosure, preferably a plush textile fabric, filled with a soft cushiony stuffed material. The feet are also constructed of a flexible fabric material which is formed to produce pockets. In the larger embodiment, wherein all or most of the fingers of a hand are placed into the pockets of the feet, the feet are at least partially padded with a soft cushiony, stuffed material. Overall, the body and feet, as a whole, are formed to create a stuffed animal.

According to the present invention, a method is provided for producing a waddle-like action in a toy figure. This method includes a step of inserting at least one part of a human hand into a pocket in one foot of the toy figure so that the one part of the human hand extends generally perpendicularly to the axis of the body of the figure and along the axis of that foot toward the front of the foot. The method also includes the step of inserting at least another part of a human hand into a pocket in the other foot of the toy figure so that the other part of the hand extends generally perpendicularly to the axis of the body of the figure and along the axis of the other foot toward the front of that other foot.

The method of the invention then provides for alternately moving the one part of the human hand and then the other part of the human hand in an upwardly, then downwardly swinging arc to provide an action resembling waddling.

When the method of the invention is used with the larger embodiment, the step of inserting at least one part of the hand into a pocket includes inserting at least the majority of the fingers of that one hand into the pocket in the foot. Similarly, the step of inserting another part of the human hand into the pocket of the other foot includes inserting at least the majority of the fingers of the other human hand into that pocket. Thus, two separate human hands are used to provide the waddling action in the larger embodiment.

In the smaller embodiment, the step of inserting at least one part of a human hand into the pocket of one foot includes inserting one finger of one hand into that pocket. Similarly, the step of inserting at least another part of the human hand into the pocket of the other foot includes inserting another finger of the same human hand into the pocket of the other foot. Thus, two fingers of one hand are used to produce the waddling action in the smaller embodiment. Alternatively, individual fingers of both hands of the user could be used to produce the waddling action in the smaller embodiment.

DETAILED DESCRIPTION

Figure 1:
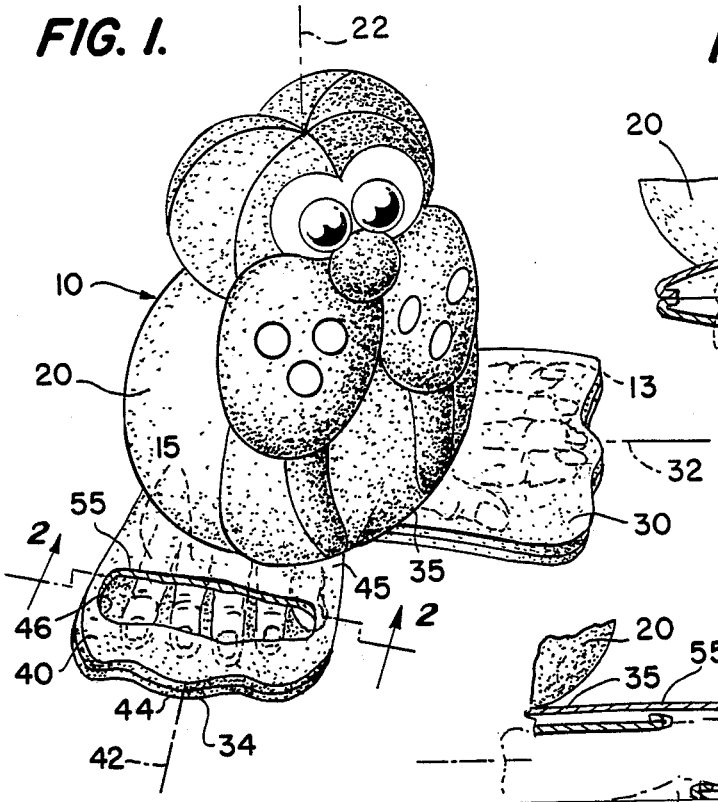
FIG. 1 is a perspective view of a toy figure according to the present invention.
Figure 2:
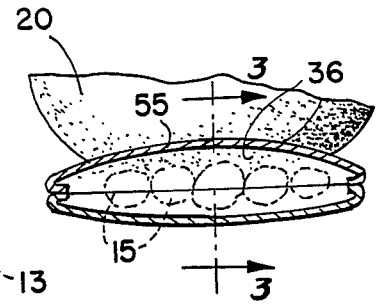
FIG. 2 is a fragmentary cross-sectional view showing a foot of the toy figure of FIG. 1 which sectional view is taken on a line 2—2 of FIG. 1.

In the following description, and in the drawing, like reference characters, when used among the various figures of the drawing, refer to like elements or features.

Referring to FIG. 1, reference character 10 generally refers to a toy figure according to one embodiment of the present invention. Specifically, toy FIG. 10 represents the larger embodiment of the two embodiments of toy figures disclosed herein, which larger embodiment is shown in FIGS. 1–5.

Toy figure 10 as shown in FIGS. 1–5 is configured to produce a waddling action utilizing all or most of the fingers of both hands of the human user, i.e., a left human hand 12 with fingers generally referred to by reference numeral 13, and a right human hand 14 with fingers generally referred to by reference character 15.

Toy FIG. 10 includes a body 20 resembling the body of a creature, which body has an axis 22 which extends generally vertically when the toy figure is in an upright condition. Coupled with the body are a pair of feet 30, 40. Left foot 30 has a lengthwise axis 32, a front 34, which front is spaced from the body 20, and a base 35 representing a region near the back of foot 30 where the foot is coupled to body 20. Foot 30 includes a pocket 36 having an entry opening 37 therein for receiving at least part of a human hand.

Similarly, right foot 40 includes a lengthwise axis 42, a front 44 spaced from body 20, and a base 45 representing the back of the foot and also representing the region at which the foot 40 is coupled with body 20. Foot 40 includes pocket 46 which can be accessed via opening 47 for insertion of at least part of the user's other hand.

Figure 5:
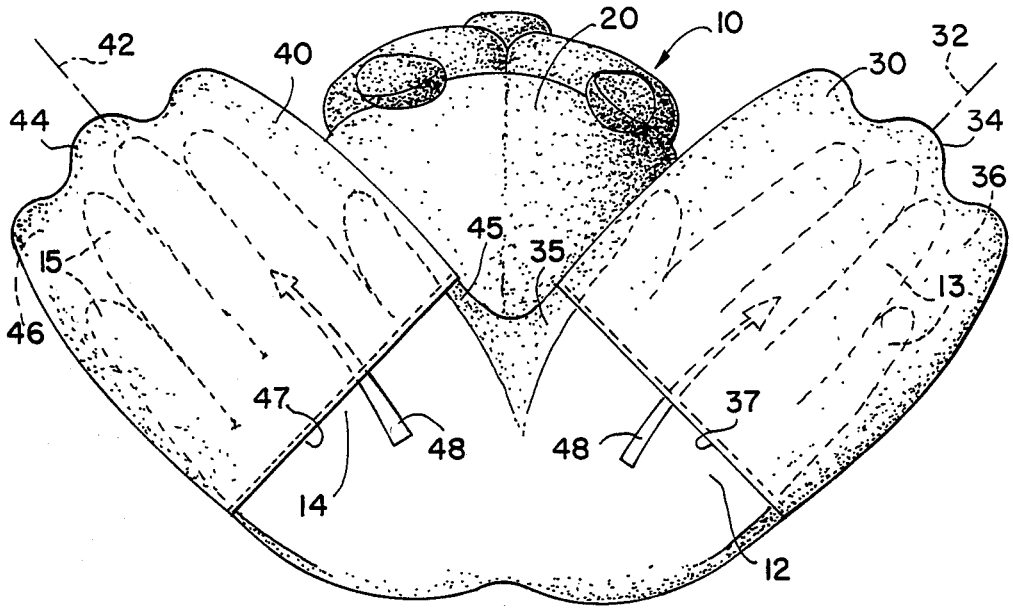
FIG. 5 is a bottom elevational view of the toy figure of FIG. 1.
Figure 6:
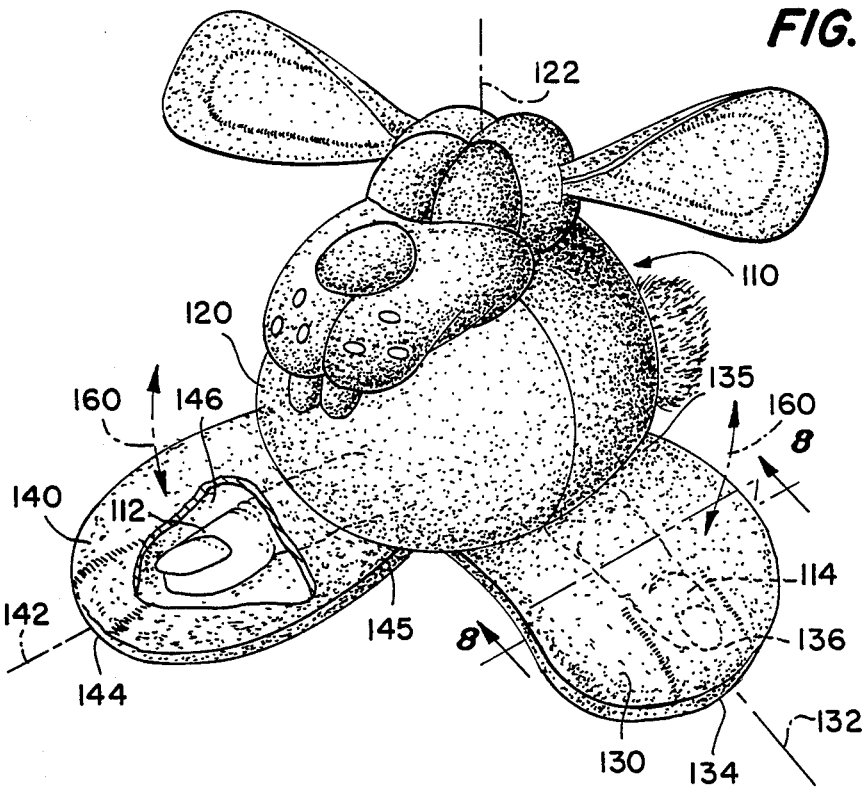
FIG. 6 is a perspective view of another embodiment of a toy figure according to the present invention.
Figure 7:
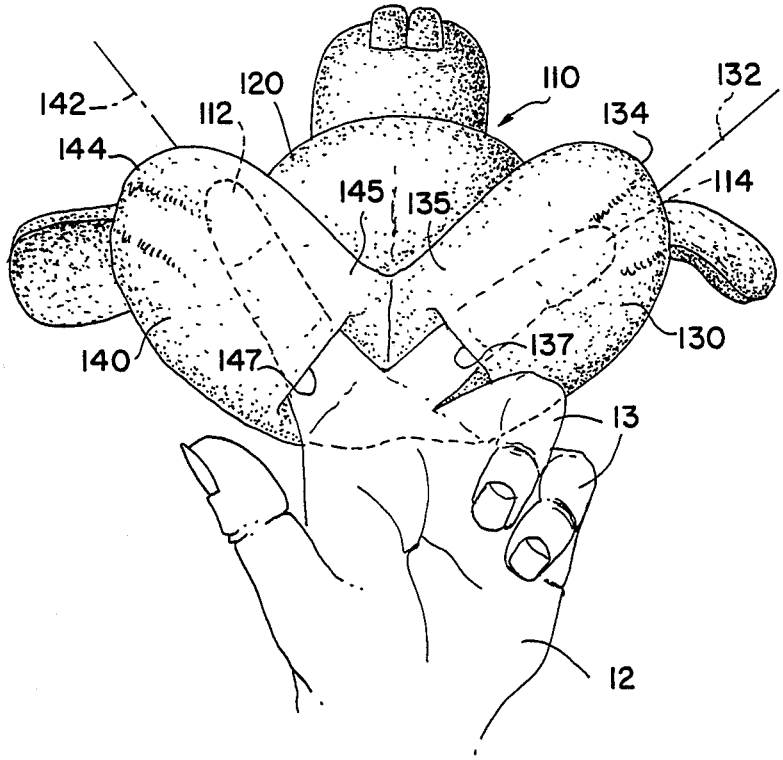
FIG. 7 is a bottom view of the toy figure of FIG. 6.
Figure 8:
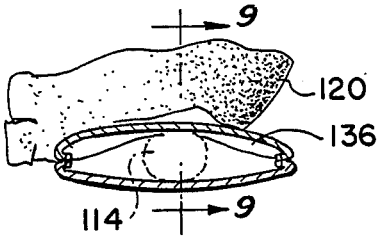
FIG. 8 is a fragmentary cross-sectional view of a foot of the toy figure of FIG. 6 taken on the line 8—8 of FIG. 6.
Figure 9:
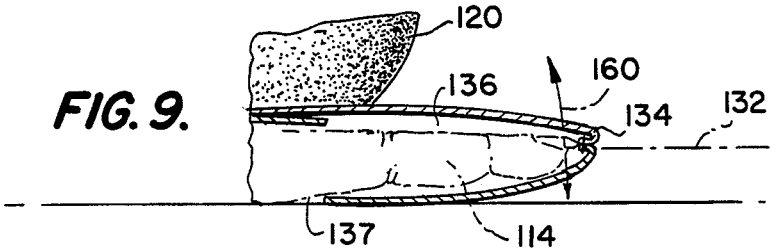
FIG. 9 is another fragmentary cross-sectional view of a foot of the toy figure of FIG. 6, the cross section being taken on a line 9—9 of FIG. 8.

The user's left hand 12 is placed in pocket 36 of foot 30 via opening 37. Likewise, the user's right hand 14 is placed in pocket 46 of right foot 40 via opening 47. Arrows 48 in FIG. 5 show the direction in which hands 12, 14 are inserted into pockets 36, 46.

Figure 4:
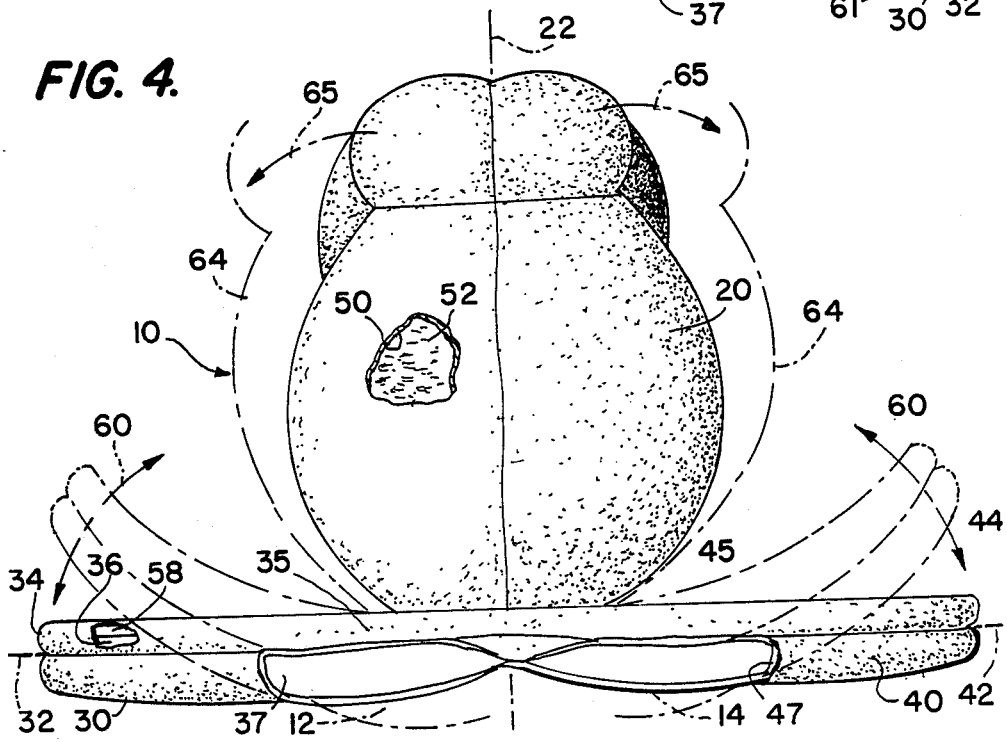
FIG. 4 is a rear elevational view of the toy figure of FIG. 1.

Body 20 is constructed of a flexible fabric enclosure 50 (best seen in the cutaway area of body 20 illustrated in FIG. 4). The fabric enclosure 50 is preferably a soft, plush textile material. Enclosure 50 is filled with a soft, cushiony, stuffed material 52 (see the cutaway portion of FIG. 4), as is well-known with stuffed animals.

Feet 30, 40 are also preferably constructed of a flexible fabric material 55 forming a pair of enclosures. That is, the fabric 55 of feet 30, 40 is formed to provide the pockets 36, 46. Preferably, the same fabric material is used for the fabric enclosure 55 forming the feet 30, 40 as is used for the fabric enclosure 50 forming the body 20. Preferably, too, the feet are at least partially padded with a soft, cushiony, stuffed material or padding 58 (see the cutaway portion of foot 30 of FIG. 4) on the upperside of feet 30, 40 in the particular embodiment of FIGS. 1–5.

Figure 3:
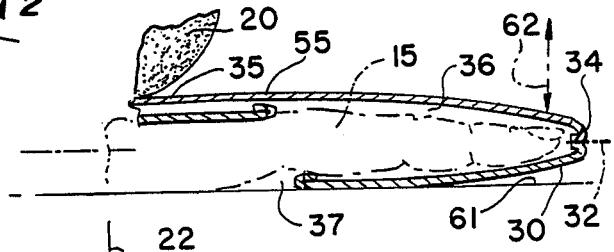
FIG. 3 is a further fragmentary cross-sectional view illustrating details of one foot of the toy figure of FIG. 1, the view of FIG. 3 being taken on a line 3—3 of FIG. 3.

To produce the waddling action for the toy FIG. 10, the user will move the fingers of one hand, say the left hand 12, in an upward and downward arcuate swinging or sweeping movement and then alternately move the fingers of the right hand 14 through the same kind of movement. This alternate right hand and left hand sweeping movement is repeated to produce the waddling action, and the hands may also be moved forward at the same time so that the movement resembles forward progress of the toy FIG. 10 as it waddles along surface 61 (FIG. 3). The upward sweeping movement is shown in phantom lines and by arrows 60 in FIG. 4. Specifically, the tips of the fingers 13, 15 of the user are moved up, and then down as shown by arrow 62 in FIG. 3, while the base of the fingers 13, 15 remains relatively still, as compared with the tips of the fingers, to provide the pivoting, swinging or sweeping action.

During this pivoting, swinging or sweeping action of the fingers 13, 15 of hands 12, 14, the body 20 of toy figure 10 will also move from side to side as shown by phantom lines 64 and arrow 65 in FIG. 4. This side to side movement enhances the resemblance of the motion to waddling and adds to the entertainment, play and amusement value of the toy FIG. 10. In this regard, swinging movement of the fingers 13 of the left hand 12 effect movement of the body 20 in the opposite direction, i.e., to the right, and vice versa.

The smaller embodiment of FIGS. 6–9 and the method of using that embodiment is similar in most respects to that of the previously described, larger embodiment of FIGS. 1–5, except that the toy figure is smaller, and the pocket of each foot is sized and configured to receive only a single finger. The toy figure of the embodiment of FIGS. 6–9 is generally referred to by reference numeral 110. Toy figure 110 is, as indicated, activated by individual fingers, preferably index finger 112 of one hand 12 and the finger 114 next to index finger 112. While the movement of toy figure 110 will be described by referring to movement of two fingers of one hand, it will be understood that one finger, such as the index finger, of one hand may be used to activate one foot, and a single finger of the other hand may be used to activate the other foot.

Toy figure 110 has a body 120 resembling the body of a creature. Body 120 has an upright axis 122 comparable to axis 22 in the previously described embodiment.

Coupled to the body 120 is a left foot 130 and a right foot 140. Left foot 140 includes an axis 132, a front 134 disposed away from the body, and a base 135 where the left foot 130 is coupled to the body 120. Left foot 130 also includes a pocket 136 for receiving finger 112 through opening 137 to the pocket. Pocket 136 is sized and configured to snugly receive finger 112.

Similarly, toy FIG. 110 includes a right foot 140 coupled to body 120. Right foot 140 includes an axis 142, a front 144 disposed remotely from body 120, a base 145 disposed adjacent body 120 and a pocket 146 to which access is gained via opening 147. Of course, pocket 146 is sized and configured to snugly engage finger 114.

The waddling action in the toy FIG. 110 is produced in essentially the same manner as described and illustrated in connection with toy FIG. 10 of the previous embodiment, except that the alternate upward sweeping action is effected by individual fingers 112, 114 rather than by all or most of the fingers of two hands, as in the previous embodiment. The fabric enclosure and filling thereof with a stuffed material is preferably the same in toy figure 110 as in toy FIG. 10 except that the feet 130, 140 of toy FIG. 110 do not require the upper padding 58 as shown in FIG. 4 of the previously described embodiment.

As will be seen from the drawing, the toy figures 10, 110 of the present invention both preferably resemble stuffed animals, and, in particular, both preferably resemble highly characterized stuffed animals. Toy FIG. 10 of the first, larger embodiment is a highly characterized walrus, whereas toy FIG. 10 of the smaller embodiment is a highly characterized dog.

While the present invention has been described in connection with two particular preferred embodiments, it will be understood that any additional embodiments, variations, modifications and the like are possible within the spirit and scope of the appended claims.

What is claimed is:

1. A toy figure capable of movement resembling waddling, which movement is effected by the sequential upward and downward movement of the user's hands, the toy figure comprising:

a generally round body;

a head atop the body;

a pair of feet serving as the base for the figure, wherein the head, the body and the feet are vertically arranged to give the figure the appearance of standing, the body being attached directly to the feet without any intermediate or leg portions therebetween, the feet extending perpendicularly to the vertical orientation of the standing figure and diverging away from each other in the forward direction in which the figure would waddle;

a pocket within each foot, each pocket extending forwardly in the same diverging direction as the longitudinal axis of the foot in which the pocket is contained, the pocket openings being adjacent to each other at their point of attachment to the body of the figure, each pocket receiving one of the user's hands;

wherein the direct attachment of the body to the feet, the orientation of the pockets and the movement of the user's hands cooperatively compel a movement of the figure resembling waddling.

2. The toy figure of claim 1, in which each pocket is padded about all of its interior surfaces.

3. The toy figure of claim 1, in which the head is directly and fixedly attached to the body portion, whereby the waddling motion of the toy figure produces a responsive side-to-side motion of the head.

* * * * *

UNITED STATES PATENT AND TRADEMARK OFFICE

CERTIFICATE OF CORRECTION

PATENT NO. : 4,838,827

DATED : June 13, 1989

INVENTOR(S) : Roger L. Schlaifer

It is certified that error appears in the above-identified patent and that said Letters Patent is hereby corrected as shown below:

Column 4, line 35:

Delete "Left foot 140" and insert --Left foot 130-- therefor.

Signed and Sealed this

Second Day of July, 1991

*Attest:*

HARRY F. MANBECK, JR.

*Attesting Officer*

*Commissioner of Patents and Trademarks*